US006314611B1

(12) United States Patent
Sauers

(10) Patent No.: US 6,314,611 B1
(45) Date of Patent: Nov. 13, 2001

(54) BLADED DISK BRUSH ROLLER ASSEMBLY FOR A VACUUM CLEANER SWEEPER

(75) Inventor: Carl B. Sauers, Barberton, OH (US)

(73) Assignee: Baker McMillen Co., Stow, OH (US)

( * ) Notice: Subject to any disclaimer, the term of this patent is extended or adjusted under 35 U.S.C. 154(b) by 0 days.

(21) Appl. No.: 09/534,763

(22) Filed: Mar. 24, 2000

(51) Int. Cl.[7] ..... A47L 9/04
(52) U.S. Cl. ..... 15/376; 15/392
(58) Field of Search ..... 15/375, 376, 392

(56) References Cited

U.S. PATENT DOCUMENTS

| | | | | |
|---|---|---|---|---|
| 1,286,321 | | 12/1918 | Hoover . | |
| 1,323,925 | * | 12/1919 | Stewart | 15/375 |
| 1,426,765 | | 8/1922 | Pesarillo . | |
| 1,582,652 | | 4/1926 | Albrecht . | |
| 1,599,991 | | 9/1926 | Demaree . | |
| 1,680,741 | | 8/1928 | Lang . | |
| 1,681,453 | | 8/1928 | Wright . | |
| 1,718,293 | * | 6/1929 | Hoover | 15/376 X |
| 1,815,084 | | 7/1931 | White . | |
| 1,878,856 | | 9/1932 | Jones . | |
| 1,972,745 | | 9/1934 | Martinet . | |
| 1,972,796 | | 9/1934 | Schaad . | |
| 1,973,679 | | 9/1934 | Bass . | |
| 1,999,696 | | 4/1935 | Kitto . | |
| 2,085,700 | * | 6/1937 | Kitto | 15/375 |
| 2,178,003 | * | 10/1939 | Smellie | 15/375 |
| 2,263,762 | | 11/1941 | Dow et al. . | |
| 2,271,553 | | 2/1942 | Smellie . | |
| 2,281,863 | | 5/1942 | Smellie . | |
| 2,372,404 | | 3/1945 | Taylor . | |
| 2,707,792 | | 5/1955 | Waller . | |
| 2,734,211 | | 2/1956 | Vance . | |
| 2,782,439 | | 2/1957 | Ballard . | |
| 3,193,866 | | 7/1965 | Jones . | |
| 3,321,799 | | 5/1967 | Hackworth . | |
| 3,959,847 | | 6/1976 | Kaulig et al. . | |
| 4,209,873 | | 7/1980 | Schaefer . | |
| 4,361,929 | | 12/1982 | Jinkins . | |
| 4,403,372 | | 9/1983 | Keane et al. . | |
| 4,429,430 | | 2/1984 | Lyman . | |
| 4,847,944 | | 7/1989 | Lackner . | |
| 4,854,006 | * | 8/1989 | Nishimura et al. | 15/375 |
| 4,912,805 | | 4/1990 | Krasznai et al. . | |
| 5,193,243 | | 3/1993 | Stegens . | |
| 5,435,038 | | 7/1995 | Sauers . | |
| 5,452,490 | | 9/1995 | Brundula et al. . | |
| 6,032,327 | * | 3/2000 | Oka et al. | 15/375 X |
| 6,058,561 | * | 5/2000 | Song et al. | 15/375 X |
| 6,079,079 | * | 6/2000 | Oka | 15/375 |

* cited by examiner

*Primary Examiner*—Chris K. Moore
(74) *Attorney, Agent, or Firm*—Emerson & Skeriotis; Roger D. Emerson; John M. Skeriotis

(57) ABSTRACT

A brush roller assembly for a vacuum cleaner sweeper which includes a rotatable spindle having a longitudinal axis, a first end, a second end and a central portion, a first bladed disk positioned on the first end of the rotatable spindle, the first bladed disk including a central portion which is positioned substantially perpendicular to the longitudinal axis of the rotatable spindle when the first bladed disk is positioned on the first end of the rotatable spindle and at least one fan blade projection outwardly extending from the periphery of the central portion of the first bladed disk, the at least one fan blade projection being oriented to facilitate the movement of outside air from the first end of the rotatable spindle toward the central portion of the rotatable spindle, a first end cap attached to the first end of the rotatable spindle, a second bladed disk positioned on the second end of the rotatable spindle, the second bladed disk including a central portion which is positioned substantially perpendicular to the longitudinal axis of the rotatable spindle when the second bladed disk is positioned on the second end of the rotatable spindle and at least one fan blade projection outwardly extending from the periphery of the central portion of the second bladed disk, the at least one fan blade projection being oriented to facilitate the movement of outside air from the second end of the rotatable spindle toward the central portion of the rotatable spindle and a second end cap attached to the second end of the rotatable spindle.

25 Claims, 2 Drawing Sheets

BLADED DISK BRUSH ROLLER ASSEMBLY FOR A VACUUM CLEANER SWEEPER

BACKGROUND AND SUMMARY OF THE INVENTION

The present invention relates generally to new and novel improvements in a bladed disk brush roller assembly for a vacuum cleaner sweeper. More particularly, the present invention relates to a bladed disk brush roller assembly for a vacuum cleaner sweeper which pulls outside "clean" air from the ends of the brush roller assembly and moves debris, such as dirt and dust, away from the brush roller assembly end guards and bearing assemblies toward the middle of the brush roller assembly where it is removed from the brush roller assembly by the vacuum of the vacuum cleaner sweeper.

Brush roller assemblies for vacuum cleaner sweepers are well known and have been described in numerous references, including a number of issued United States patents. A typical brush roller assembly includes a rotatably mounted and motor driven spindle having a brush on a cylindrical outer surface thereof and a non-rotatable mounting structure at each end to mount the brush roller assembly to a vacuum cleaner sweeper housing. While the mounting structure may vary considerably, one type of known mounting structure includes end assemblies at each end of the spindle, the end assemblies including a rotatable stub shaft, a bearing and an end cap member which is fixedly secured to the vacuum cleaner sweeper housing.

Certain problems are known to exist with known prior art brush roller assemblies for vacuum cleaner sweepers. In particular, debris, such as dirt and dust, tends to collect in such known prior art brush roller assemblies. This is thought to be due, at least in part, to the lack of movement of air from the ends of the brush roller assembly to the central portion of the brush roller assembly where debris, such as dirt and dust, can be removed from the brush roller assembly by the vacuum of the vacuum cleaner sweeper.

Accordingly, an object of the present invention is the provision of a bladed disk brush roller assembly for a vacuum cleaner sweeper which facilitates the movement of outside air from the ends of the brush roller assembly to the central portion of the brush roller assembly where debris, such as dirt and dust, can be removed from the brush roller assembly by the vacuum of the vacuum cleaner assembly.

This and other objects of the present invention are attained by a brush roller assembly for a vacuum cleaner sweeper which includes a rotatable spindle having a longitudinal axis, a first end, a second end and a central portion, a first bladed disk positioned on the first end of the rotatable spindle, the first bladed disk including a central portion which is positioned substantially perpendicular to the longitudinal axis of the rotatable spindle when the first bladed disk is positioned on the first end of the rotatable spindle and at least one fan blade projection outwardly extending from the periphery of the central portion of the first bladed disk, the one or more fan blade projections being oriented to facilitate the movement of outside air from the first end of the rotatable spindle toward the central portion of the rotatable spindle, a first end cap attached to the first end of the rotatable spindle, a second bladed disk positioned on the second end of the rotatable spindle, the second bladed disk including a central portion which is positioned substantially perpendicular to the longitudinal axis of the rotatable spindle when the second bladed disk is positioned on the second end of the rotatable spindle and at least one fan blade projection outwardly extending from the periphery of the central portion of the second bladed disk, the one or more fan blade projections being oriented to facilitate the movement of outside air from the second end of the rotatable spindle toward the central portion of the rotatable spindle and a second end cap attached to the second end of the rotatable spindle.

Other advantages and novel features of the present invention will become apparent in the following detailed description of the invention when considered in conjunction with the accompanying drawings.

DETAILED DESCRIPTION OF THE DRAWINGS

Figure 1:
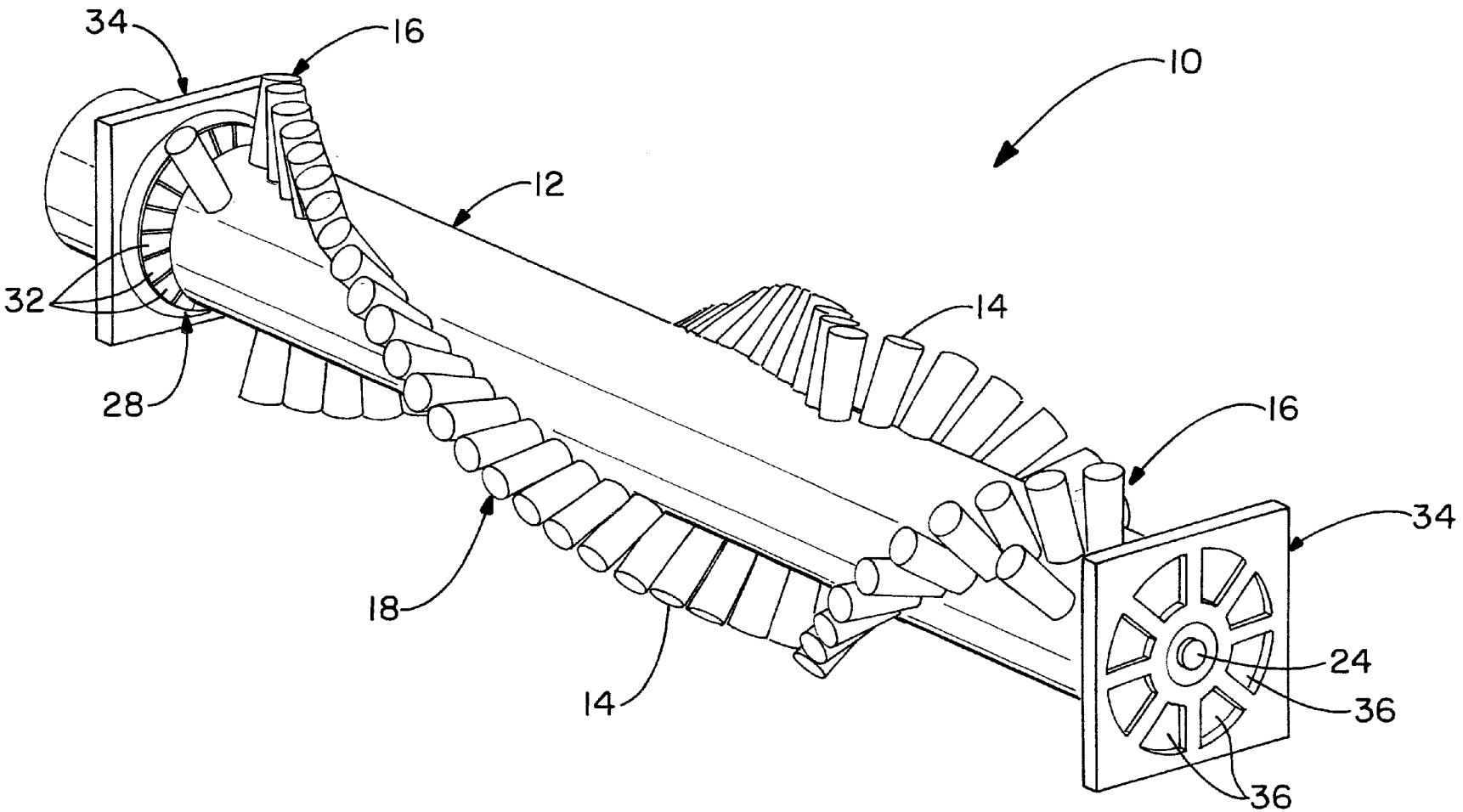
FIG. 1 is a perspective view of a bladed disk brush roller assembly for a vacuum cleaner sweeper in accordance with a preferred embodiment of the present invention.
Figure 2:
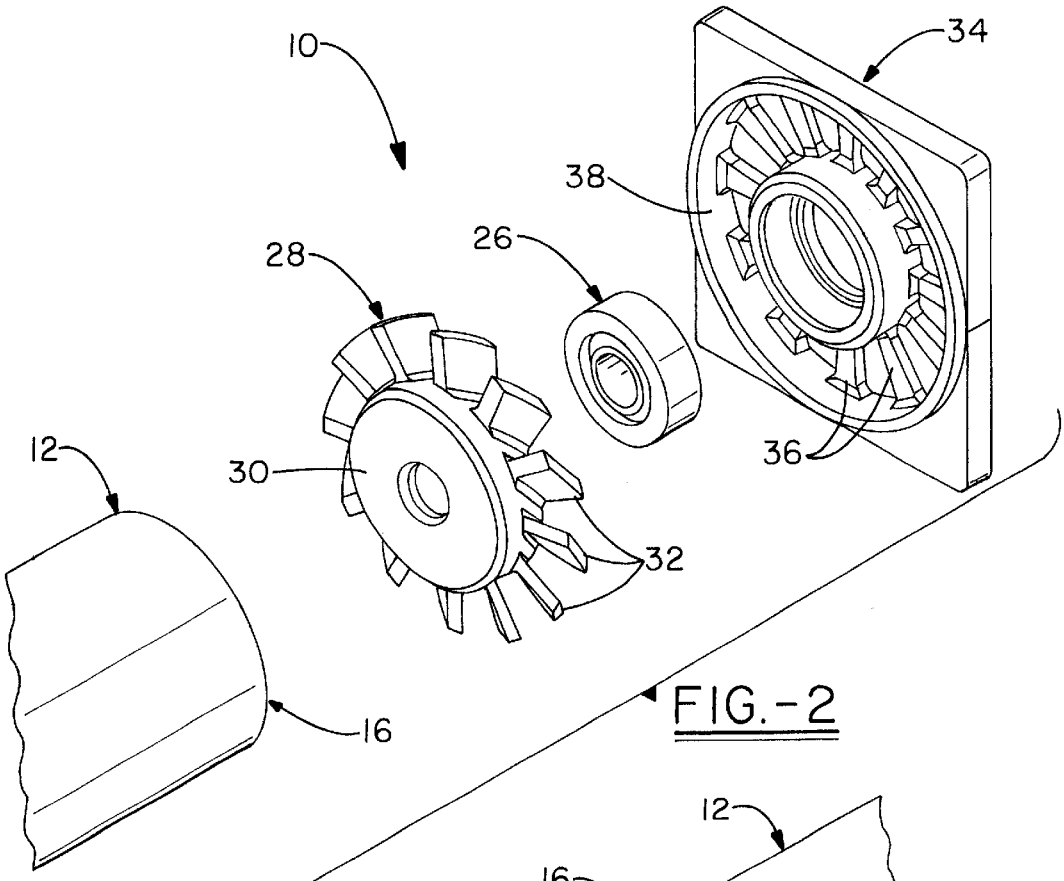
FIG. 2 is a first exploded prospective view of the preferred embodiment of a bladed disk brush roller assembly for a vacuum cleaner sweeper in accordance with the present invention shown in FIG. 1.
Figure 3:
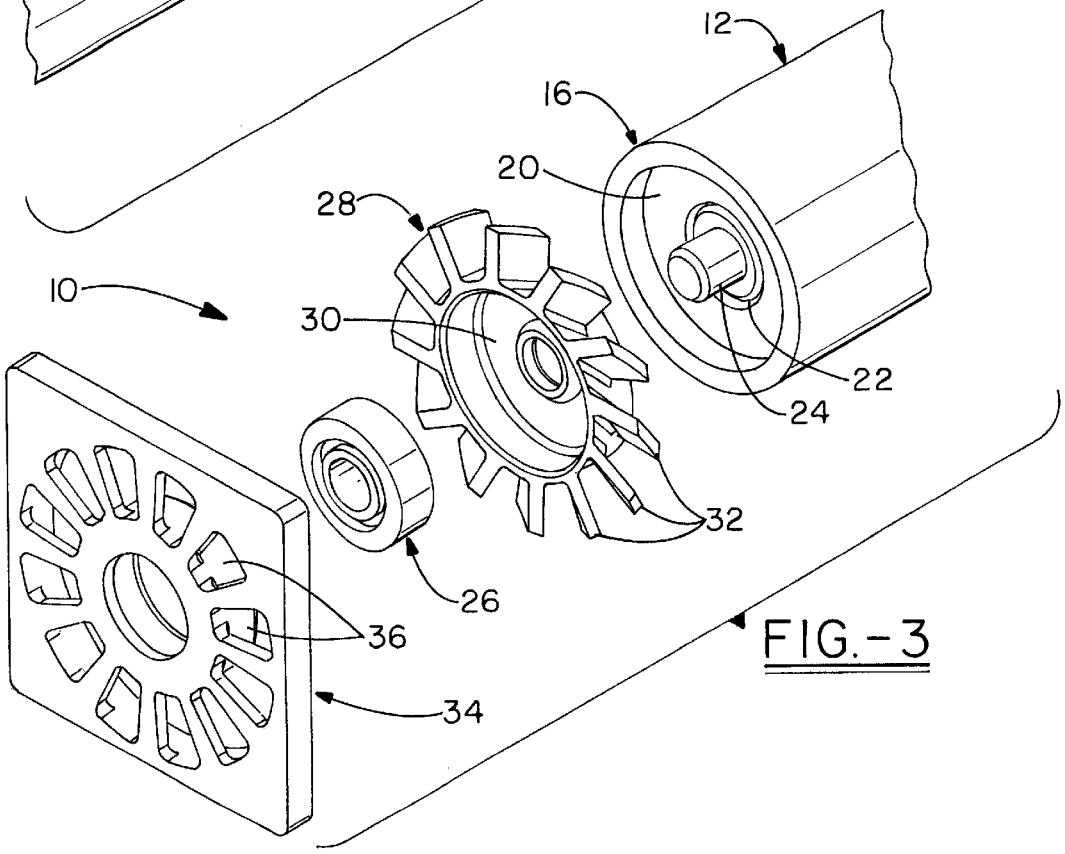
FIG. 3 is a second exploded prospective view of the preferred embodiment of a bladed disk brush roller assembly for a vacuum cleaner sweeper in accordance with the present invention shown in FIG. 1.

In the following detailed description of a preferred embodiment of the present invention, reference is made to the accompanying drawings which, in conjunction with this detailed description, illustrate and describe a preferred embodiment of a bladed disk brush roller assembly for a vacuum cleaner sweeper in accordance with the present invention. Referring to FIGS. 1 through 3, which show a perspective view of a bladed disk brush roller assembly for a vacuum cleaner sweeper in accordance with a preferred embodiment of the present invention, a first exploded prospective view of the preferred embodiment of a bladed disk brush roller assembly for a vacuum cleaner sweeper in accordance with the present invention shown in FIG. 1 and a second exploded prospective view of the preferred embodiment of a bladed disk brush roller assembly for a vacuum cleaner sweeper in accordance with the present invention shown in FIG. 1, respectively, bladed disk brush roller assembly for a vacuum cleaner sweeper is generally identified by reference number 10. Bladed disk brush roller assembly 10 includes rotatable spindle 12 having a generally cylindrical configuration and at least one brush 14 is preferably positioned on the outer cylindrical surface of rotatable spindle 12. Rotatable spindle 12 includes two (2) end portions 16, of which only one (1) is shown in FIGS. 2 and 3, and central portion 18. Rotatable spindle 12 also preferably includes recess 20 in each of end portions 16 and opening 22 which removably receives outwardly extending pin 24. Rotatable spindle 12 is preferably fabricated from wood, although, if desired, a plastic material or some other material may alternatively be used. Outwardly extending pin 24 is preferably fabricated from steel, although, if desired, some other material may be used. Bladed disk brush roller assembly 10 also preferably includes two (2) bearings 26 positioned in central portion 30 of each bladed disk 28 and over outwardly extending pin 24 to facilitate the rotation of rotatable spindle 12.

Bladed disk brush roller assembly 10 also includes two (2) bladed disks 28 positioned on each end portion 16 of rotatable spindle 12. Bladed disks 28 include central portion 30 which is positioned substantially perpendicular to the longitudinal axis of rotatable spindle 12 when bladed disks 28 are on placed end portions 16 of rotatable spindle 12 and at least one fan blade projection 32 outwardly extending from the periphery of central portion 30 of bladed disks 28. The one or more fan blade projections 32 of bladed disks 28 are preferably oriented at an angle relative to central portion 30 of bladed disks 28 to facilitate the movement of outside air from end portions 16 of rotatable spindle 12 toward central portion 18 of rotatable spindle 12 where outside air, as well as any debris, such as dirt and dust, carried with the outside air, is removed from bladed disk brush roller assembly 10 by the vacuum of the vacuum cleaner sweeper. The angle of one or more fan blade projections 32 of bladed disks 28 relative to central portion 30 of bladed disks 28 is preferably in the range of ten (10) to sixty (60) degrees and is most preferably approximately twenty (20) degrees. Bladed disks 28 are preferably fabricated from a plastic material, or alternatively, are fabricated as sheet metal stampings, although, if desired, other materials may be used.

Bladed disk brush roller assembly 10 also includes two (2) end caps 34 attached to bearings 26 in such a manner as to permit rotation of rotatable spindle 12 and bladed disks 28. End caps 34 preferably include at least one opening, and more preferably a plurality of openings 36 elongated in a radial direction positioned in a circular configuration approximately corresponding to the position of one or more fan blade projections 32 on bladed disks 28, to facilitate the movement of outside air from end portions 16 of rotatable spindle 12 toward central portion 18 of rotatable spindle 12 where outside air, as well as any debris, such as dirt and dust, carried with the outside air, is removed from bladed disk brush roller assembly 10 by the vacuum of the vacuum cleaner sweeper. End caps 34 preferably include recess 38 and bladed disks 28 are preferably positioned, at least in part, in recess 38 of end caps 34. In addition, at least a portion of central portion 30 of bladed disks 28 is positioned in recess 20 in end portions 16 of rotatable spindle 12. End caps 34 are preferably fabricated from a plastic material, although, if desired, other materials may be used to fabricate end caps 34. In addition, if desired, rotatable spindle 12 and bladed disks 28 could be fabricated as an integral integrated assembly.

Accordingly, although the present invention has been described above in detail, the same is by way of illustration and example only and is not to be taken as a limitation on the present invention. It is apparent to those having a level of ordinary skill in the relevant art that other variations and modifications in bladed disk brush roller assembly for a vacuum cleaner sweeper in accordance with the present invention, as described and shown herein, could be readily made using the teachings of the present invention. Accordingly, the scope and content of the present invention are to be defined only by the terms of the appended claims.

What is claimed is:

1. A brush roller assembly for a vacuum cleaner sweeper, said brush roller assembly comprising:

a rotatable spindle having a longitudinal axis, a first end, a second end and a central portion;

a first bladed disk positioned on said first end of said rotatable spindle, said first bladed disk including a central portion which is positioned substantially perpendicular to said longitudinal axis of said rotatable spindle when said first bladed disk is positioned on said first end of said rotatable spindle and at least one opening to facilitate the movement of outside air from said first end of said rotatable spindle toward said central portion of said rotatable spindle;

a first end cap attached to said first end of said rotatable spindle;

a second bladed disk positioned on said second end of said rotatable spindle, said second bladed disk including a central portion which is positioned substantially perpendicular to said longitudinal axis of said rotatable spindle when said second bladed disk is positioned on said second end of said rotatable spindle and at least opening to facilitate the movement of outside air from said second end of said rotatable spindle toward said central portion of said rotatable spindle;

a second end cap attached to said second end of said rotatable spindle and, wherein said first end cap includes a recess and said first bladed disk is positioned, at least in part, in said recess in said first end cap and said second end cap includes a recess and said second bladed disk is positioned, at least in part, in said recess in said second end cap.

2. The brush roller assembly for a vacuum cleaner sweeper in accordance with claim 1, wherein said at least one opening in said first bladed disk is angled relative to said central portion of said first bladed disk to form at least one fan blade projection to facilitate the movement of outside air from said first end of said rotatable spindle toward said central portion of said rotatable spindle and said at least one opening in said second bladed disk is angled relative to said central portion of said second bladed disk to form at least one fan blade projection to facilitate the movement of outside air from said second end of said rotatable spindle toward said central portion of said rotatable spindle.

3. The brush roller assembly for a vacuum cleaner sweeper in accordance with claim 2, wherein said at least one fan blade projection in said first bladed disk is oriented at a ten (10) degree to sixty (60) degree angle relative to said central portion of said first bladed disk to facilitate the movement of outside air from said first end of said rotatable spindle toward said central portion of said rotatable spindle and said at least one fan blade projection in said second bladed disk is oriented at a ten (10) degree to sixty (60) degree angle relative to said central portion of said second bladed disk to facilitate the movement of outside air from said second end of said rotatable spindle toward said central portion of said rotatable spindle.

4. The brush roller assembly for a vacuum cleaner sweeper in accordance with claim 2, wherein said at least one fan blade projection in said first bladed disk is oriented at an angle of approximately twenty (20) degrees relative to said central portion of said first bladed disk to facilitate the movement of outside air from said first end of said rotatable spindle toward said central portion of said rotatable spindle and said at least one fan blade projection in said second bladed disk is oriented at an angle of approximately twenty (20) degrees relative to said central portion of said second bladed disk to facilitate the movement of outside air from said second end of said rotatable spindle toward said central portion of said rotatable spindle.

5. The brush roller assembly for a vacuum cleaner sweeper in accordance with claim 1, said brush roller assembly further includes a first bearing positioned on said first end of said rotatable spindle and a second bearing positioned on said second end of said rotatable spindle to facilitate the rotation of said rotatable spindle.

6. The brush roller assembly for a vacuum cleaner sweeper in accordance with claim 1, wherein said first end cap includes at least one opening to further facilitate the movement of outside air from said first end of said rotatable spindle toward said central portion of said rotatable spindle and said second end cap includes at least one opening to further facilitate the movement of outside air from said second end of said rotatable spindle toward said central portion of said rotatable spindle.

7. The brush roller assembly for a vacuum cleaner sweeper in accordance with claim 6, wherein said at least one opening in said first end cap is elongated in a radial direction to further facilitate the movement of outside air from said first end of said rotatable spindle toward said central portion of said rotatable spindle and said at least one opening in said second end cap is elongated in a radial direction to further facilitate the movement of outside air from said second end of said rotatable spindle toward said central portion of said rotatable spindle.

8. The brush roller assembly for a vacuum cleaner sweeper in accordance with claim 1, wherein said first bladed disk and said second bladed disk are fabricated from a plastic material.

9. The brush roller assembly for a vacuum cleaner sweeper in accordance with claim 1, wherein said first bladed disk and said second bladed disk are fabricated as sheet metal stampings.

10. The brush roller assembly for a vacuum cleaner sweeper in accordance with claim 1, wherein said rotatable spindle is substantially cylindrical in configuration and includes a cylindrical outer surface and at least one brush is positioned on said cylindrical outer surface of said rotatable spindle.

11. The brush roller assembly for a vacuum cleaner sweeper in accordance with claim 1, wherein said first end cap and said second end cap are fabricated from a plastic material.

12. The brush roller assembly for a vacuum cleaner sweeper in accordance with claim 1, wherein said rotatable spindle, said first bladed disk and said second bladed disk are fabricated as an integrated assembly.

13. A brush roller assembly for a vacuum cleaner sweeper, said brush roller assembly comprising:

a rotatable spindle having a longitudinal axis, a first end, a second end and a central portion;

a first bladed disk positioned on said first end of said rotatable spindle, said first bladed disk including a central portion which is positioned substantially perpendicular to said longitudinal axis of said rotatable spindle when said first bladed disk is positioned on said first end of said rotatable spindle and at least one opening to facilitate the movement of outside air from said first end of said rotatable spindle toward said central portion of said rotatable spindle;

a first end cap attached to said first end of said rotatable spindle;

a second bladed disk positioned on said second end of said rotatable spindle, said second bladed disk including a central portion which is positioned substantially perpendicular to said longitudinal axis of said rotatable spindle when said second bladed disk is positioned on said second end of said rotatable spindle and at least opening to facilitate the movement of outside air from said second end of said rotatable spindle toward said central portion of said rotatable spindle;

a second end cap attached to said second end of said rotatable spindle; and wherein said first end of said rotatable spindle includes a recess and at least a portion of said central portion of said first bladed disk is positioned in said recess in said first end of said rotatable spindle and said second end of said rotatable spindle includes a recess and at least a portion of said central portion of said second bladed disk is positioned in said recess in said second end of said rotatable spindle.

14. The bladed disk for a brush roller assembly for a vacuum cleaner sweeper in accordance with claim 13, wherein said at least one opening in said first bladed disk is angled relative to said central portion of said first bladed disk to form at least one fan blade projection to facilitate the movement of outside air from the first end or the second end of the rotatable spindle toward the central portion of the rotatable spindle and said at least one opening in said second bladed disk is angled relative to said central portion of said second bladed disk to form at least one fan blade projection to facilitate the movement of outside air from the first end or the second end of the rotatable spindle toward the central portion of the rotatable spindle.

15. The brush roller assembly for a vacuum cleaner sweeper in accordance with claim 14, wherein said at least one fan blade projection in said first bladed disk is oriented at a ten (10) degree to sixty (60) degree angle relative to said central portion of said first bladed disk to facilitate the movement of outside air from said first end of said rotatable spindle toward said central portion of said rotatable spindle and said at least one fan blade projection in said second bladed disk is oriented at a ten (10) degree to sixty (60) degree angle relative to said central portion of said second bladed disk to facilitate the movement of outside air from said second end of said rotatable spindle toward said central portion of said rotatable spindle.

16. The brush roller assembly for a vacuum cleaner sweeper in accordance with claim 14, wherein said at least one fan blade projection in said first bladed disk is oriented at an angle of approximately twenty (20) degrees relative to said central portion of said first bladed disk to facilitate the movement of outside air from said first end of said rotatable spindle toward said central portion of said rotatable spindle and said at least one fan blade projection in said second bladed disk is oriented at an angle of approximately twenty (20) degrees relative to said central portion of said second bladed disk to facilitate the movement of outside air from said second end of said rotatable spindle toward said central portion of said rotatable spindle.

17. The brush roller assembly for a vacuum cleaner sweeper in accordance with claim 13, said brush roller assembly further includes a first bearing positioned on said first end of said rotatable spindle and a second bearing positioned on said second end of said rotatable spindle to facilitate the rotation of said rotatable spindle.

18. The brush roller assembly for a vacuum cleaner sweeper in accordance with claim 13, wherein said first end cap includes at least one opening to further facilitate the movement of outside air from said first end of said rotatable spindle toward said central portion of said rotatable spindle and said second end cap includes at least one opening to further facilitate the movement of outside air from said second end of said rotatable spindle toward said central portion of said rotatable spindle.

19. The brush roller assembly for a vacuum cleaner sweeper in accordance with claim 6, wherein said at least one opening in said first end cap is elongated in a radial direction to further facilitate the movement of outside air from said first end of said rotatable spindle toward said central portion of said rotatable spindle and said at least one opening in said second end cap is elongated in a radial direction to further facilitate the movement of outside air from said second end of said rotatable spindle toward said central portion of said rotatable spindle.

20. The brush roller assembly for a vacuum cleaner sweeper in accordance with claim 13, wherein said first bladed disk and said second bladed disk are fabricated from a plastic material.

21. The brush roller assembly for a vacuum cleaner sweeper in accordance with claim 13, wherein said first bladed disk and said second bladed disk are fabricated as sheet metal stampings.

22. The brush roller assembly for a vacuum cleaner sweeper in accordance with claim 13, wherein said rotatable spindle is substantially cylindrical in configuration and includes a cylindrical outer surface and at least one brush is positioned on said cylindrical outer surface of said rotatable spindle.

23. The brush roller assembly for a vacuum cleaner sweeper in accordance with claim 13, wherein said first end cap includes a recess and said first bladed disk is positioned, at least in part, in said recess in said first end cap and said second end cap includes a recess and said second bladed disk is positioned, at least in part, in said recess in said second end cap.

24. The brush roller assembly for a vacuum cleaner sweeper in accordance with claim 13, wherein said first end cap and said second end cap are fabricated from a plastic material.

25. The brush roller assembly for a vacuum cleaner sweeper in accordance with claim 13, wherein said rotatable spindle, said first bladed disk and said second bladed disk are fabricated as an integral integrated assembly.

* * * * *